US005649840A

United States Patent [19]

Muto

[11] Patent Number: 5,649,840

[45] Date of Patent: Jul. 22, 1997

[54] POWER SOURCE SOCKET FOR A VEHICLE

[75] Inventor: Toshiya Muto, Aichi-ken, Japan

[73] Assignee: Kabushiki Kaisha Tokai Rika Denki Seisakusho, Aichi-ken, Japan

[21] Appl. No.: 674,264

[22] Filed: Jul. 1, 1996

[30] Foreign Application Priority Data

Jul. 5, 1995 [JP] Japan ..... 7-170002

[51] Int. Cl.[6] ..... H01R 17/18

[52] U.S. Cl. ..... 439/668; 439/700; 439/824

[58] Field of Search ..... 439/668, 34, 188, 439/700, 824, 638, 319, 819

[56] References Cited

U.S. PATENT DOCUMENTS

| | | | |
|---|---|---|---|
| 2,469,939 | 5/1949 | Walton et al. | 439/668 |
| 3,646,498 | 2/1972 | Reed | 439/188 |
| 5,201,677 | 4/1993 | Takayama | 439/668 |
| 5,230,641 | 7/1993 | Wharton | 439/700 |
| 5,248,259 | 9/1993 | Naito et al. | 439/34 |

FOREIGN PATENT DOCUMENTS

| | | | |
|---|---|---|---|
| 0748809 | 11/1944 | Germany | 439/824 |

*Primary Examiner*—David L. Pirlot
*Assistant Examiner*—Tho Dac Ta
*Attorney, Agent, or Firm*—Nikaido, Marmelstein, Murray & Oram LLP

[57] ABSTRACT

A power source socket includes a casing fixed to a vehicle. The socket has a contact coupled to a power supply. The contact of the socket is electrically connected to a contact of a plug of an electrical device when the plug is inserted into the casing. The socket has a contact fixed to the casing. The socket also has a movable contact movably accommodated in the casing. The movable contact has a first contact portion and a second contact portion. The first contact portion contacts the fixed contact. The second contact portion contacts the plug contact. The first contact portion also contacts the fixed contact in accordance with the engagement of the plug contact and the second contact portion of the movable contact when the plug is inserted into the casing. The contact portion of the movable contact is separated from the fixed contact in accordance with the movement of the plug contact away from the movable contact when the plug is removed from the casing. A coil spring is located between the movable contact and the fixed contact. The spring biases the movable contact in a direction away from the fixed contact.

19 Claims, 2 Drawing Sheets

POWER SOURCE SOCKET FOR A VEHICLE

BACKGROUND OF THE INVENTION

1. Field of the Invention

This invention generally relates to a power source socket provided in a vehicle, that is, a cigarette lighter socket, and more particularly, to a power source socket into which the plug of an electrical device is inserted when used in the vehicle.

2. Description of the Related Art

Vehicles generally have a power source socket serving as a cigarette lighter on the instrument panel. Recently, electrical devices that may be connected to the socket for power are on the market. These devices, such as lamps, radios and televisions have a plug to be connected to the power source socket and are mostly used in a vehicle.

The material of the contact terminal of the plug of an electrical device may differ depending on the manufacturer. In general, a contact terminal having a higher durability, for example a higher arc resistance or a higher resistance against wear and transfer of contact materials, is more expensive. The wear and transfer of a contact means that one of two connecting parts is dissolved and adhered to the other. Inexpensive materials like copper, copper alloy, silver, nickel-plated copper, nickel-plated copper alloy and nickel-plated silver are used to reduce the manufacturing cost of plugs. On the other hand, expensive materials like alloy of silver and tungsten are used to manufacture power sockets for better contact durability.

When an electrical device is being powered, inserting its plug into the power source socket of a vehicle or removing the plug from the socket produces arc discharge. This develops wear, oxidation and sulfidization of the plug, resulting in a poor connection between the socket and the plug.

SUMMARY OF THE INVENTION

It is an object of the present invention to provide a power socket that maintains a good connection with a plug made of inexpensive material having low durability.

To achieve the above object and other objects, a power socket having a casing fixed to a vehicle is provided. The casing has a contact connected to a power source. Inserting the plug of an electrical device into the casing electrically connects the contact of the plug to the contact of the power socket. The power socket has a contact fixed to the casing. The socket has a movable contact attached to the casing. The movable contact has a first contact portion, which contacts the fixed contact and a second contact portion, which contacts the contact of the plug. Inserting the plug into the casing allows the plug contact to engage the second contact portion of the movable contact. Then, the first contact portion contacts the fixed contact. Removing the plug from the casing disengages the plug contact from the movable contact. This separates the contact portion of the movable contact from the fixed contact. A first bias member is located between the movable contact and the fixed contact. The first bias member biases the movable contact in a direction away from the fixed contact.

BRIEF DESCRIPTION OF THE DRAWINGS

The features of the present invention that are believed to be novel are set forth with particularity in the appended claims. The invention together with the objects and advantages thereof, may best be understood by reference to the following description of the presently preferred embodiments together with the accompanying drawings in which:

DETAILED DESCRIPTION OF THE PREFERRED EMBODIMENTS

Figure 2:
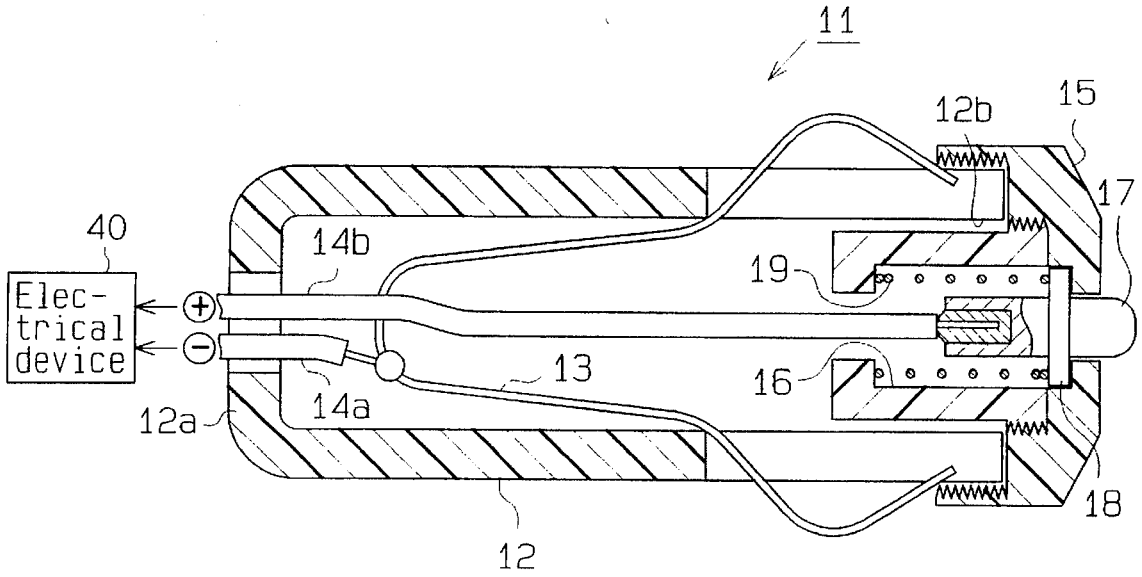
FIG. 2 is a sectional side view of a plug.

An embodiment of the present invention will now be described referring to the drawings. First, description of a plug is given. As shown in FIG. 2, a bottle-shaped casing 12 constitutes a part of a plug 11. The casing 12 is made of an insulating material such as resin. The casing 12 has an end 12*a* and an opening 12*b* at the opposite ends of the casing. A substantially U-shaped grounding piece 13 is supported in the casing 12 with its sides protruded from slits formed on the perimeter of the casing 12. The grounding piece 13 elastically deforms in a direction perpendicular to the axial direction of the casing 12. A minus cord 14*a* is coupled to the grounding piece 13. The cord 14*a* extends from a hole formed in the bottom 12*a* of the casing 12. The opening 12*b* of the casing 12 is sealed with a cap 15.

A chamber 16 is formed in the cap 15. The chamber 16 movably accommodates a plug contact 17 along the axial direction. The plug contact 17 is made of inexpensive and relatively nondurable material, such as copper, copper alloy, silver, nickel plated copper, nickel plated copper alloy and nickel plated silver. A plus cord 14*b* is coupled to a plug contact 17. The cord 14*b* is exposed from the opening at the bottom of the casing 12. The cords 14*a* and 14*b* may be coupled to various kinds of electrical devices 40.

A flange 18 is formed at the perimeter of the plug contact 17. A coil spring 19 is located between the flange 18 and the inner wall of the chamber 16. The coil spring 19 constantly biases the plug 17 toward the opening of the casing 12 (i.e., toward the right side of FIG. 2). The plug contact 17 protrudes outside from the cap 15 when no external force is applied thereto. The protrusion of the plug 17 is restricted by the contact of the cap 15 and the flange 18.

Figure 1:
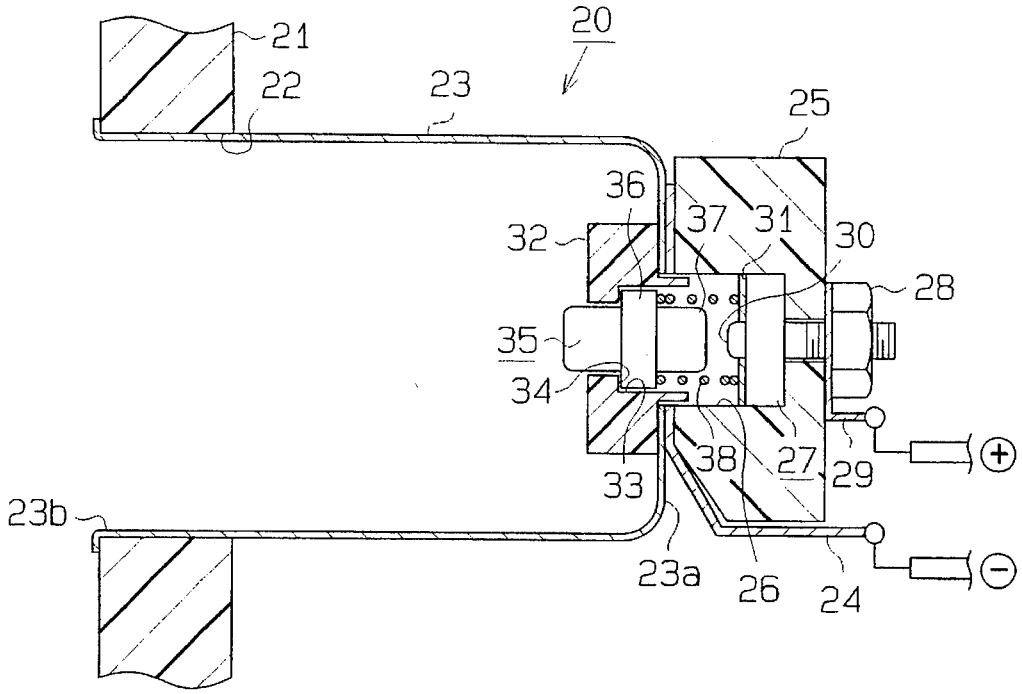
FIG. 1 is a sectional side view of a power socket for a vehicle according to an embodiment of the present invention.

A socket for a vehicle will now be described. As shown in FIG. 1, a panel 21, to which a power socket 20 is attached, has a hole 22. A bottle-shaped metal casing 23 is attached to the edge of the hole 22. The casing 23 has a larger diameter than the casing 12. The casing 23 has an end 23*a* and an opening 23*b*. A base 25 made of insulating material such as resin is attached to the outer wall of the bottom of the casing 23 with a minus terminal plate 24 located therebetween. A recess 26 is formed in the base 25 to face the minus terminal plate 24. A fixed contact 27 is accommodated in the recess 26. The fixed contact 27 is made of more expensive and durable material than that of the plug contact 17, such as an alloy of silver and tungsten.

The fixed contact 27 has a shaft protruding from the base 25. A nut 28 screwed to the shaft fixes the contact 27 to the base 25 thereby connecting the contact 27 to the plus terminal 29. A projection 30 is formed on the surface of the fixed contact 27. A washer 31 made of insulating material such as resin is placed on the surface of the fixed contact 27 around the projection 30

A boss 32 made of insulating material such as resin is provided on the inner wall of the bottom of the metal casing 23. The end 23*a* of the metal casing 23 has a hole formed therethrough. The boss 32 is fixed by inserting a part thereof in the hole. The boss 32 has a support hole 33 formed therein. The hole 33 is on the same axial line as the hole formed on the bottom 23*a*. The support hole 33 has a step 34 formed on its inner wall. The support hole 33 movably supports a contact 35 in the axial direction. The movable contact 35 is made of the same material as the fixed contact 27.

A flange 36 is formed on the perimeter of the movable contact 35. Engagement of the flange 36 and the step 34 of the support hole 33 restricts the inward movement of the movable contact 35. A projection 37 is provided in the center of the flange 36 and protrudes toward the fixed contact 27. The projection 37 constitutes a first contact portion which contacts the fixed contact 27. A part of the movable contact 35, which protrudes in the opposite direction of the projection 37, constitutes a second contact portion, which contacts the plug contact 17.

A coil spring 38 as a bias member is located between the movable contact 35 and the fixed contact 27. An end of the coil spring 38 contacts the flange 36 of the movable contact 35 and the other end contacts the insulating washer 31. The movement of the movable contact 35 toward the fixed contact is restricted by engagement of the projection 37 of the movable contact 35 with the fixed contact 27. The shortest contracted length of the spring 38 is shorter than the combined length of the projection 37 of the movable contact 35 and the projection 30 of the fixed contact 27. The spring 38 therefore does not prevent the movable contact from contacting the fixed contact. The urging force of the coil spring 38 is less than that of the coil spring 19.

The operation of the device will now be described. As the plug 11 is inserted in the metal casing 23 of the socket 20, the grounding piece 13 is pressed by the inner wall of the metal casing 23 and bends inwardly, allowing the plug 11 to be inserted in the metal casing 23. The grounding piece 13 presses itself against the inner wall of the metal casing 23 with its own resilience. The insertion of the plug 11 allows the plug contact 17 and movable contact 35 to come into contact. At this time, the coil spring 19 incorporated in the plug 11 is yet to be contracted since its urging force is greater than that of the spring 38 incorporated in the socket 20. A further insertion of the plug 11 moves the movable contact 35 toward the right side of FIG. 2 against the force of the spring 38, thereby compressing the spring 38. Engagement of the projection 37 of the movable contact 35 and the projection 30 of the fixed contact 27 restricts the rightward movement of the movable contact 35.

Figure 3:
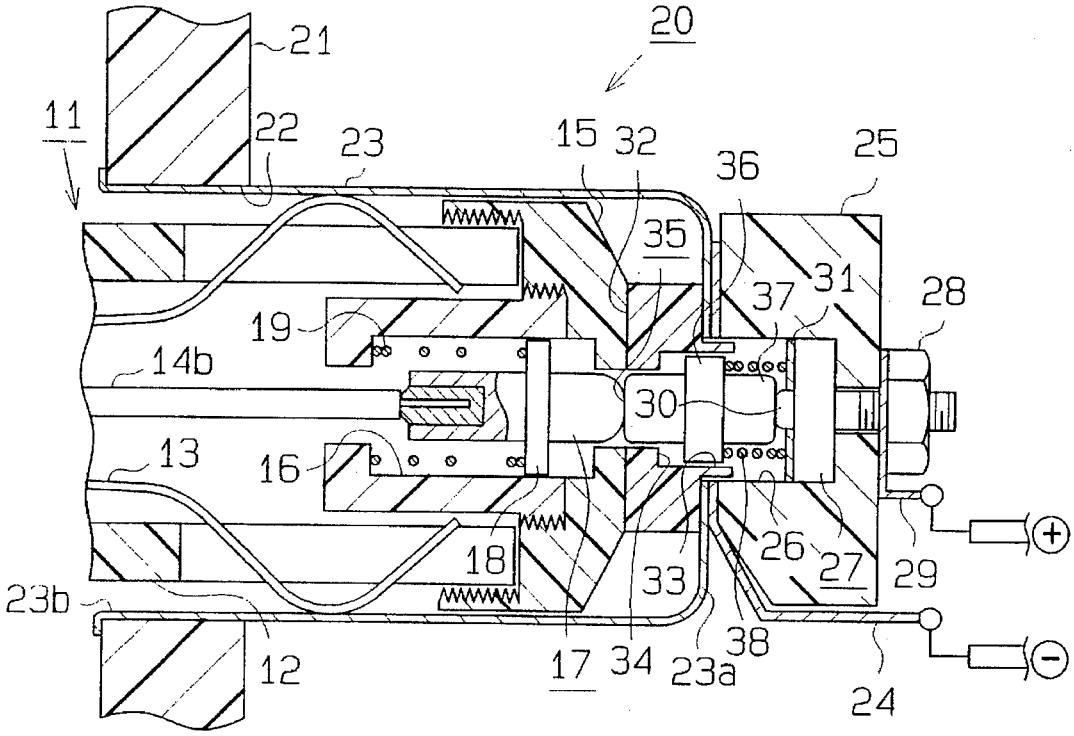
FIG. 3 is a sectional side view of a socket and a plug in which the fixed contact is in contact with the movable contact.

With an even further insertion of the plug 11 into the casing 23, the movable contact 35 pushes back the plug contact 17. This moves the plug contact 17 toward the left side of FIG. 3 against the force of the coil spring 19. The force of the spring 19 of the plug 11 and that of the spring 38 of the socket 20 are applied to the contacting part of the plug 17 and the movable contact 35 from directions opposite to each other, thereby contacting the plug contact 17 and the movable contact 35. This ensures power supply from the socket 20 to the plug 11.

Figure 4:
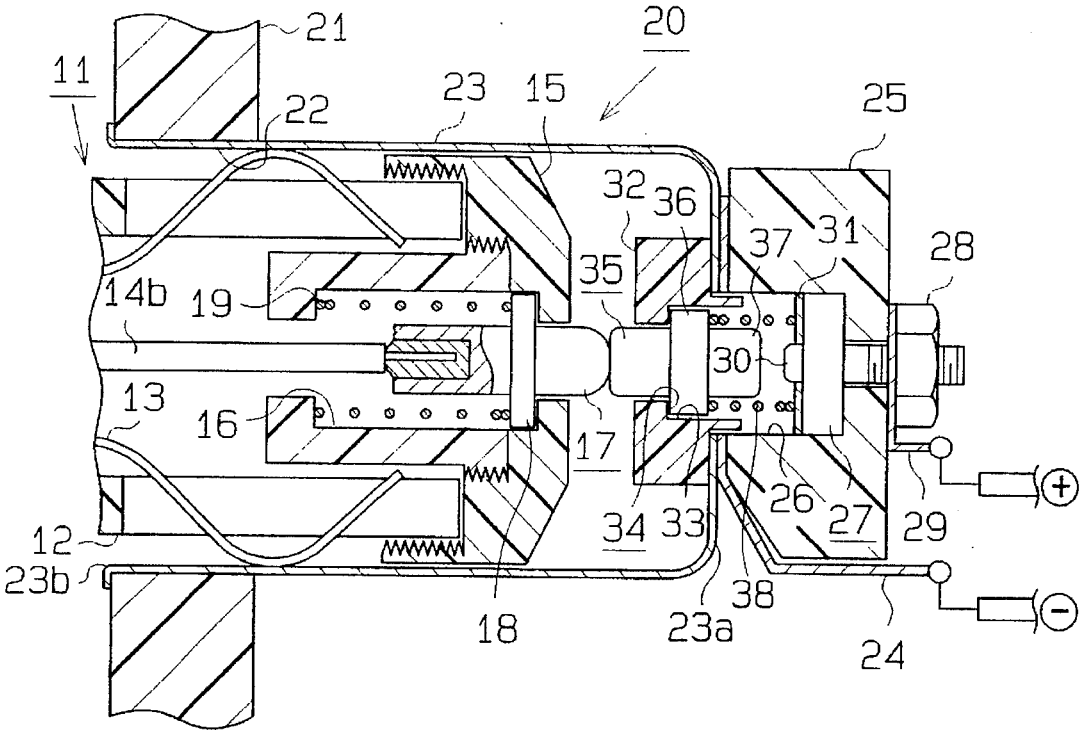
FIG. 4 is a sectional side view of a socket and a plug in which the fixed contact and the movable contact are separated.

The plug 11 is moved leftward to be removed from the socket 20. Moving the plug 11 leftward to remove it from the socket 20 as shown in FIG. 4 separates the movable contact 35 from the fixed contact 27. Then, being pressed by the force of the spring 38, the flange 36 engages the step 34 of the support hole 33, while the flange 18 of the plug contact 17, being pressed by the coil spring 19, contacts the inner wall of the chamber 16. During this process, the plug contact 17 and the movable contact 35 maintain contact by the force of the springs 19 and 38 incorporated in the plug 11 and the socket 20. Moving the plug 11 further toward the left side of FIG. 4 separates the plug contact 17 from the movable contact 35, thereby completing the removal of the plug 11 from the socket 20.

The power socket 20 having a structure described above has the following effects.

When removing the plug 11, the movable contact 35 is separated from the fixed contact 27 before the plug contact 17 is separated from the movable contact 35. The plug is thus electrically disconnected from the socket. When inserting the plug 11, the movable contact 35 contacts the fixed contact 27 after the plug contact 17 contacts the movable contact 35. The plug is electrically connected to the socket, accordingly. Therefore, even when a voltage is applied to the socket, inserting and removing of the plug 11 causes no arc discharge between the movable contact 35 and the plug contact 17. This retards deterioration of the plug contact 17 if it is made of inexpensive material of low durability.

The movable contact 35 is biased by the coil spring 38 toward the plug 11. This simplifies the structure of the socket 20 and, therefore, the assembly of the socket.

The washer 31 made of insulating material is attached to the fixed contact 27. This prevents a current flow between the fixed contact 27 and the movable contact 35 via the coil spring 38.

The projections 30 and 37 are formed on the fixed contacts 27 and 35, respectively. The combined length of the projections 30 and 37 is shorter than the shortest length of the coil spring 38. This ensures the contact of the fixed contacts 27 and 35.

The movement of the movable contact 35 toward the plug 11 is restricted by engagement of the flange 36 formed on the perimeter of the movable contact 35 and the step 34 of the support hole 33 formed in the boss. The movement of the movable contact 35 is restricted by a such simple structure.

The above described embodiment may be modified as follows. The coil spring 19 incorporated in the plug 11 may be omitted and the plug contact 17 may be fixed in the cap 15. A leaf spring or rubber may replace the coil spring 38. The insulating washer 31 may be attached to the movable contact 35.

What is claimed is:

1. A power source socket including a casing fixed to a vehicle, said socket having a contact provided in said casing and coupled to a power supply, said contact of said socket being electrically connected to a contact of a plug of an electrical device when the plug is inserted into said casing, said power source socket comprising:

a fixed contact included in said power supply contact, said fixed contact being fixed to said casing, a movable contact included in said power supply contact, said movable contact being movably accommodated in said casing, said movable contact having a first contact portion, which contacts said fixed contact, and a second contact portion, which contacts the plug contact, said first contact portion contacting said fixed contact in accordance with the engagement of the plug contact and said second contact portion of said movable contact when said plug is inserted into the casing, the contact portion of said movable contact being separated from said fixed contact in accordance with the movement of the plug contact away from said movable contact when the plug is removed from the casing; and a first bias member located between said movable contact and said fixed contact, said first bias member biasing the movable contact in a direction away from said fixed contact.

2. The power source socket as claimed in claim 1, wherein said fixed contact and said movable contact are made of a material that is more durable than that of said plug contact.

3. The power source socket as claimed in claim 2, wherein said fixed contact and said movable contact are made of an alloy of silver and tungsten and wherein said plug contact is made of a material selected from the group consisting of copper, copper alloy, silver, nickel-plated copper, nickel-plated copper alloy and nickel-plated silver.

4. The power source socket as claimed in claim 1, wherein said first bias member is a coil spring.

5. The power source socket as claimed in claim 4 further includes a washer made of electrically insulating material located between said coil spring and said fixed contact.

6. The power source socket as claimed in claim 1, wherein said casing is bottle-shaped and has an end having a through hole, and wherein a base made of an electrically insulating material is attached to the outer wall of the end and said fixed contact is attached to said base so as to face said through hole.

7. The power source socket as claimed in claim 6, wherein said casing has a boss made of an electrically insulating material on the inner wall of said end, said boss is attached to said through hole of said end, said boss having a support hole formed on the same axial line as said fixed contact, and wherein said movable contact is movably supported in said support hole.

8. The power source socket as claimed in claim 7, wherein said support hole has a step formed therein, and movement of said movable contact is restricted by engagement of said step and said movable contact.

9. The power source socket as claimed in claim 1, wherein said plug has a bottle-shaped casing which has an end, an opening and a cap for sealing said opening, and wherein said plug contact is movably supported by said cap with a part protruding from said cap.

10. The power source socket as claimed in claim 9 further having a second bias member for biasing said plug contact in a direction such that said plug contact protrudes from said cap.

11. The power source socket as claimed in claim 10, wherein the urging force of said second bias member is greater than that of said first bias member.

12. A power source socket including a casing fixed to a vehicle, said socket having a contact provided in said casing and coupled to a power supply, said contact of said socket being electrically connected to a contact of a plug of an electrical device when the plug is inserted into said casing, said power source socket comprising;

a fixed contact included in said power source contact, said fixed contact being fixed to said casing;

a movable contact included in said power source contact, said movable contact being movably accommodated in said casing, said movable contact having a first contact portion, which contacts said fixed contact, and a second contact portion, which contacts the plug contact, said first contact portion contacting said fixed contact in accordance with the engagement of the plug contact and said second contact portion of said movable contact when said plug is inserted into the casing, the contact portion of said movable contact being separated from said fixed contact in accordance with the movement of the plug contact away from said movable contact when the plug is removed from the casing;

said fixed contact and said movable contact being made of a material which is more durable than that of said plug contact;

a first bias member located between said movable contact and said fixed contact, said first bias member biasing the movable contact in a direction away from said fixed contact;

an electrically insulating member located between said first bias member and said fixed contact; and a second bias member attached to said plug, said second bias member biasing said plug contact toward said movable contact, the urging force of said second bias member being greater than that of said first bias member.

13. The power source socket as claimed in claim 12, wherein said fixed contact and said movable contact are made of an alloy of silver and tungsten, and said plug contact is made of material selected from the group consisting of copper, copper alloy, silver, nickel-plated copper, nickel-plated copper alloy and nickel-plated silver.

14. The power source socket as claimed in claim 13, wherein said plug has a bottle-shaped casing having an end, an opening and a cap for sealing said opening, and wherein said plug contact is movably supported by said cap with a part protruding from said cap.

15. The power source socket as claimed in claim 12, wherein said first and second bias members are coil springs.

16. The power source socket as claimed in claim 15 further includes a washer made of an electrically insulating material provided between said coil spring and said fixed contact.

17. The power source socket as claimed in claim 12, wherein said casing is bottle-shaped and has an end having a through hole, and wherein a base made of an electrically insulating material is attached to the outer wall of the end, and said fixed contact is attached to said base so as to face said through hole.

18. The power source socket as claimed in claim 17, wherein said casing has a boss made of an electrically insulating material on the inner wall of said end, said boss being attached to said through hole of said end, said boss having a support hole formed on the same axial line as said fixed contact, and wherein said movable contact is movably supported in said support hole.

19. The power source socket as claimed in claim 18, wherein said support hole has a step formed therein, and movement of said movable contact is restricted by engagement of said step and said movable contact.

* * * * *